US006366023B1

(12) United States Patent
Tran et al.

(10) Patent No.: US 6,366,023 B1
(45) Date of Patent: Apr. 2, 2002

(54) STARTER MODULES FOR MOTOR VEHICLE HEADLIGHT DISCHARGE LAMPS

(75) Inventors: René Tran; Jean Marc Nicolaï , both of Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/597,947

(22) Filed: Jun. 20, 2000

(30) Foreign Application Priority Data

Jun. 21, 1999 (FR) ..... 99 08057

(51) Int. Cl.[7] ..... H01J 7/44

(52) U.S. Cl. ..... 315/70; 307/10.6; 336/110; 336/213; 336/220; 336/221; 336/222; 315/57

(58) Field of Search ..... 315/70, 82, 57; 307/10.6, 9.1; 336/170, 110, 213, 220, 221, 222, 233, 182

(56) References Cited

U.S. PATENT DOCUMENTS 3,754,541 A * 8/1973 Sasayama ..... 315/209 CD
3,766,456 A * 10/1973 Carow ..... 318/138
4,194,239 A * 3/1980 Jayaram et al. ..... 363/109
5,726,537 A 3/1998 Andreas et al. ..... 315/311

FOREIGN PATENT DOCUMENTS

| | | |
|---|---|---|
| DE | 197 51 548 | 6/1999 |
| EP | 0 515 958 | 12/1992 |
| EP | 0 740 494 | 10/1996 |

OTHER PUBLICATIONS

Patent Abstracts of Japan vol. 1999 & JP 10 270270 A, Oct. 1998.
French Search Report dated Feb. 17, 2000.

* cited by examiner

*Primary Examiner*—Don Wong
*Assistant Examiner*—Thuy Vinh Tran
(74) *Attorney, Agent, or Firm*—Morgan & Finnegan, LLP

(57) ABSTRACT

A starter module for a discharge lamp, especially for a motor vehicle, includes a high tension transformer which has a magnetic circuit component such as an annular core, on which a primary winding (1*b*) and a secondary winding are wound. The transformer further includes an arrangement for modifying its magnetic characteristics so as to reduce the saturation level of the secondary winding.

15 Claims, 5 Drawing Sheets

STARTER MODULES FOR MOTOR VEHICLE HEADLIGHT DISCHARGE LAMPS

FIELD OF THE INVENTION

The present invention relates to starter modules for discharge lamps, especially for motor vehicles.

BACKGROUND OF THE INVENTION

This discussion of the background is illustrated in FIG. 1 of the attached drawings, a brief description of which appears later in this specification. As shown in FIG. 1, a conventional starter module for a discharge lamp comprises a transformer 1 having a secondary winding 1*a* connected in series with the discharge lamp 3. The primary winding 1*b* of the transformer is connected in series with a switching element 2, such as an IGBT thyristor interruptor. A capacitor 4 is connected in parallel with the circuit branch which includes the interrupter 2 and the primary winding 1*b*.

During starting of the lamp, the interruptor 2 and the transformer 1 cause a high tension starting pulse, of the order of 12 to 25 kV, to be generated between the electrodes of the discharge lamp. Then, and in particular in normal operation, the transformer 1 plays no part in the operation of the discharge lamp, except through its secondary winding 1*a* which acts as a self-inductance.

The transformers of starter modules employed for discharge lamps in motor vehicle headlights are generally so dimensioned, electrically and mechanically, that their secondary winding 1*a* has a high saturation level, i.e. an intensity of saturation current which is in general greater than 4 amperes.

It is however desirable to be able to miniaturise the starter modules and their transformers so that they can be incorporated either in the discharge lamp bases or in connecters which are adapted to receive the bases of the discharge lamps, or again, in a compact electronic module which provides all or some of the functions of the control circuit (i.e. a so-called ballast circuit) in which these latter may or may not be incorporated.

Miniaturisation of a starter module transformer involves the need to have much reduced saturation levels (of the order of 1.5 amperes) for the secondary winding. This results in very high current peaks, in excess of 20 amperes, which are due in particular to the transitions generated by starting of the lamp during the lighting-up phase.

These high current peaks pose a dimensioning problem for the various components of the ballast, that is to say for the components of the power supply circuit other than those in the starter circuit.

DISCUSSION OF THE INVENTION

An object of the invention is to overcome the above problem.

According to the invention in a first aspect, a starter module for a discharge lamp, especially for a motor vehicle, including a high tension transformer which includes a magnetic circuit on which a primary winding and secondary winding are wound, is characterised in that it further includes means for modifying the magnetic characteristics of the transformer so as to depress the saturation level of the secondary winding.

Preferably, the said modifying means comprise means for providing complementary magnetisation on the transformer. In that case, the said modifying means comprise a permanent magnet disposed in the magnetic circuit. Preferably then, the permanent magnet is disposed in an air gap of the magnetic circuit.

The permanent magnet preferably includes indexing means to ensure its correct orientation.

In the case where the means for modifying the magnetic characteristics of the transformer comprise a complementary magnetising means, the complementary magnetising means comprise a third winding which is wound on the magnetic circuit and which is energised continuously or transiently.

The magnetic circuit preferably comprises an annular core.

According to the invention in a second aspect, a discharge lamp for a motor vehicle is characterised in that its base incorporates a starter module according to the invention.

According to a third aspect of the invention, a connecter for a discharge lamp for a motor vehicle is characterised in that it incorporates a starter module according to the invention.

According to the invention in a fourth aspect, an electronic module which is adapted to provide all or some of the control functions for the operation of a discharge lamp is characterised in that it includes a starter module according to the invention.

Further features and advantages of the invention will appear more clearly on a reading of the following description of some preferred embodiments of the invention, which is given by way of non-limiting example only and with reference to the accompanying drawings.

DESCRIPTION OF PREFERRED EMBODIMENTS OF THE INVENTION

Figure 1:
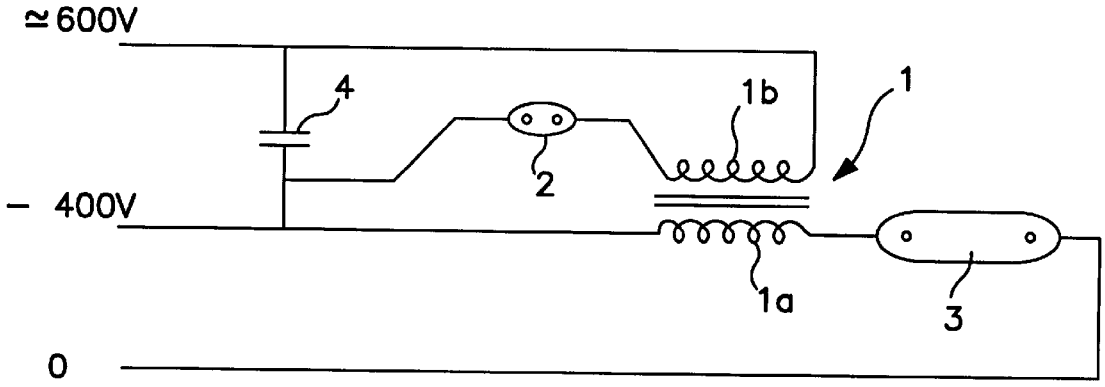
FIG. 1 PRIOR ART
FIG. 1, already discussed above, shows diagrammatically a starter module for a discharge lamp for a motor vehicle.
Figure 2:
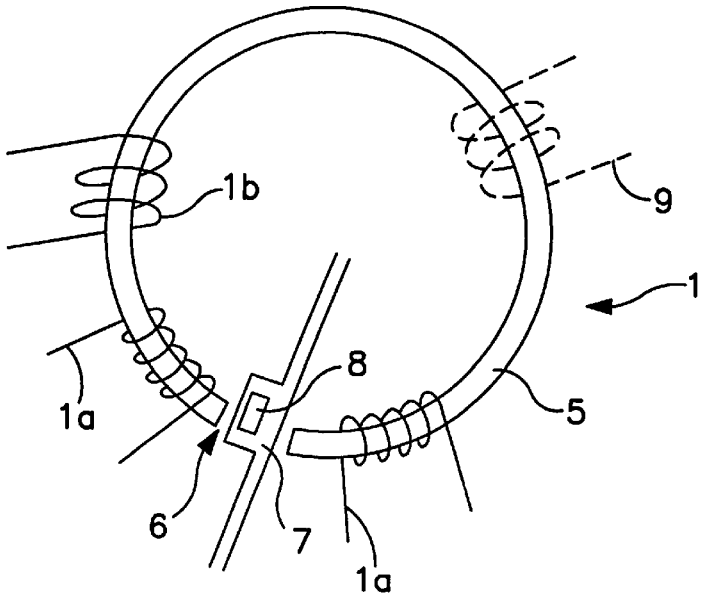
FIG. 2 shows diagrammatically a transformer of a starter module in one possible embodiment of the invention.

Reference is first made to FIG. 2, which shows the transformer 1 of this particular embodiment of a starter module according to the invention. The transformer 1 is of a toroidal type, having a ring or annular core 5 of magnetic material such as a ferrite, carrying the primary winding 1*b* and the secondary winding 1*a*. The ring 5 is not endless, but has an air gap 6 in which a permanent magnet 8 is disposed.

The permanent magnet 8 is so oriented that it displaces the hysteresis curve of the ring 5. This hysteresis curve displacement increases the value of the current at which saturation of the magnetic circuit is reached. It is for example so dimensioned that the saturation current is in the range 1.5 to 4 amperes, with the overall size of the transformer being identical to a conventional one.

The permanent magnet 8 may be attached to an end portion of the ring 5. Alternatively, and as shown in FIG. 2, it may be disposed substantially in the middle of the air gap 6 without being in contact with the ring 5. It is for example held within the air gap 6 by an element 7 of a non-magnetic material which is an electrical insulator and extends across the gap 6.

Figure 3:
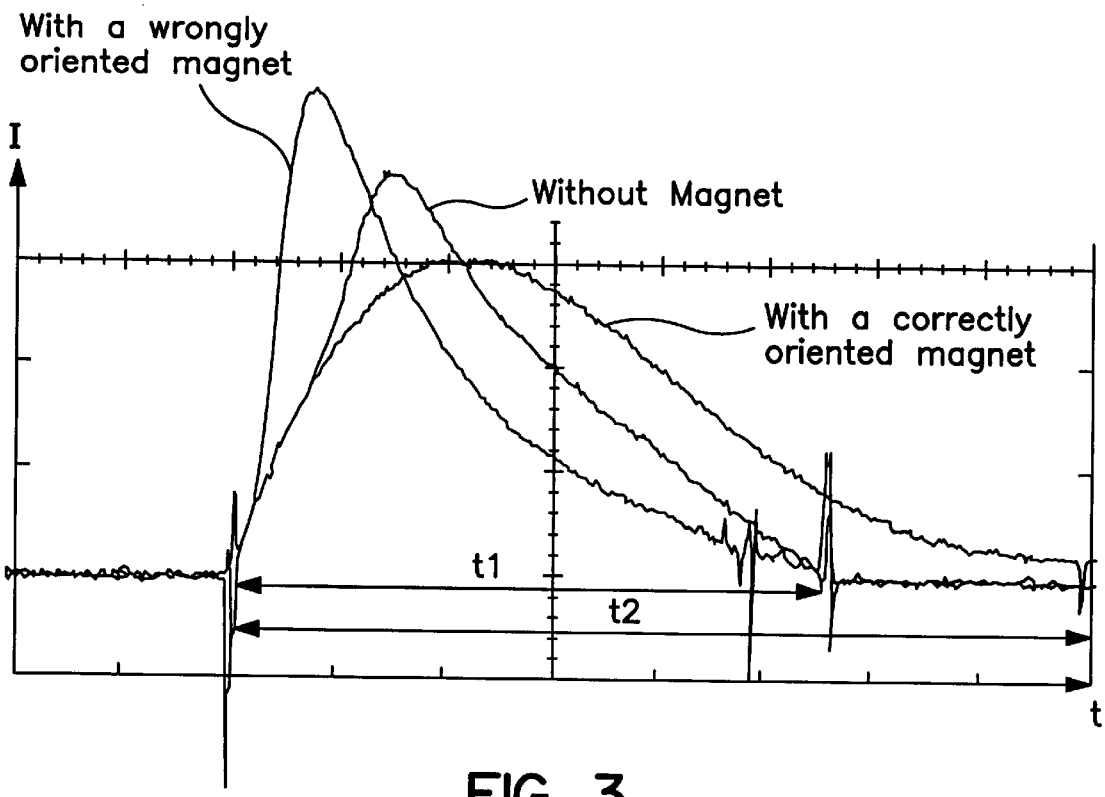
FIG. 3 is a graph which shows an example of a current pulse flowing through the secondary winding of a transformer in the case where the transformer includes a correctly oriented permanent magnet; in the case where it has no such permanent magnet; and in the case where it does have a permanent magnet but with the latter wrongly oriented.

FIG. 3 shows the curve of intensity of a current pulse I generated in the secondary winding 1*a* by a given circuit in the case of a transformer 1 having no permanent magnet.

FIG. 3 also shows the corresponding curve that applies in the case in which the transformer 1 has a correctly oriented permanent magnet, the current being generated by the same given circuit.

The third curve shown in FIG. 3 represents the corresponding current pulse, again produced by the same circuit, in the case where the transformer does include a permanent magnet but with the latter oriented in the wrong direction.

It can be seen from FIG. 3 that the presence of a correctly positioned permanent magnet greatly attenuates the current peak, but that if this magnet is not correctly oriented, the opposite effect is true and the peak is greatly amplified.

In the case where the magnet is correctly oriented, the duration of the current peak, t, is increased (from time t1 to time t2 in FIG. 3), and this facilitates starting of the lamp.

In order to avoid orientation of the permanent magnet in the wrong direction, indexing means are provided on the latter to show the correct sense in which the magnet should be oriented on the transformer during fitting. For example the magnet 8 may have a particular form which prevents it being fitted in the wrong orientation.

In order to increase the value of the current at which saturation of the magnetic circuit is obtained, alternative means may be employed in place of a permanent magnet introduced into the magnetic core ring of the transformer. In particular, the increase in the value of current for which saturation of the magnetic circuit is obtained can be achieved by energising a complementary winding 9 shown in broken lines in FIG. 2 and wound on the ring 5. The winding 9 may be energised either permanently or transiently.

Figure 4:
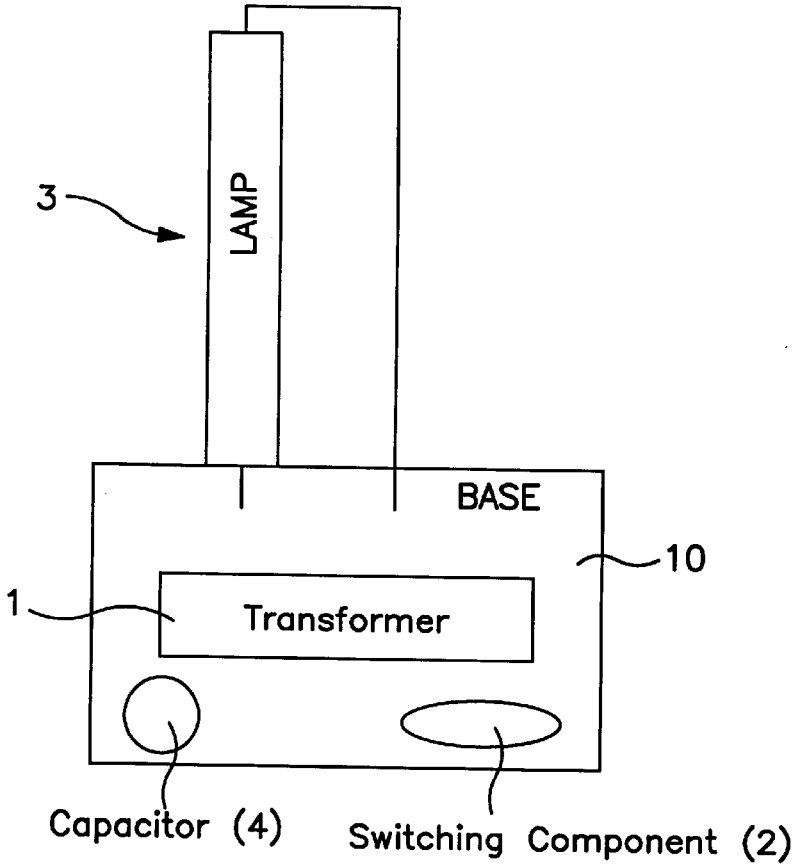
FIGS. 4 and 5 show the incorporation of a transformer, of the same type as that shown in FIG. 2, in a lamp base.
Figure 5:
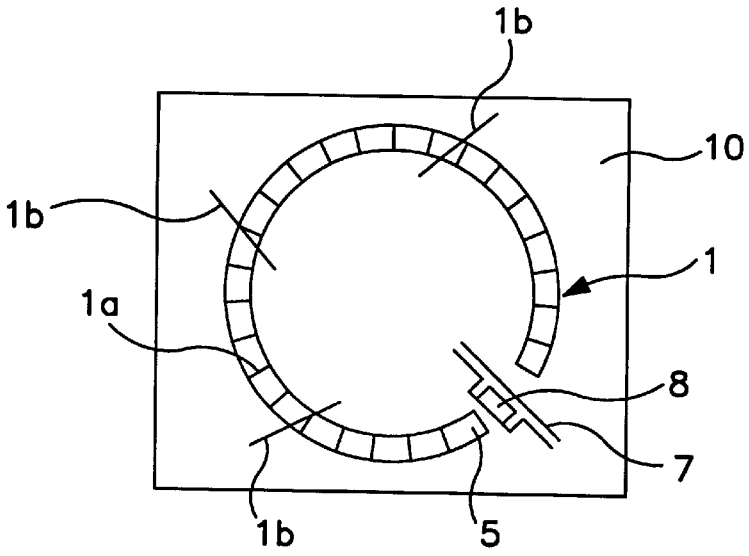
Figure 6:
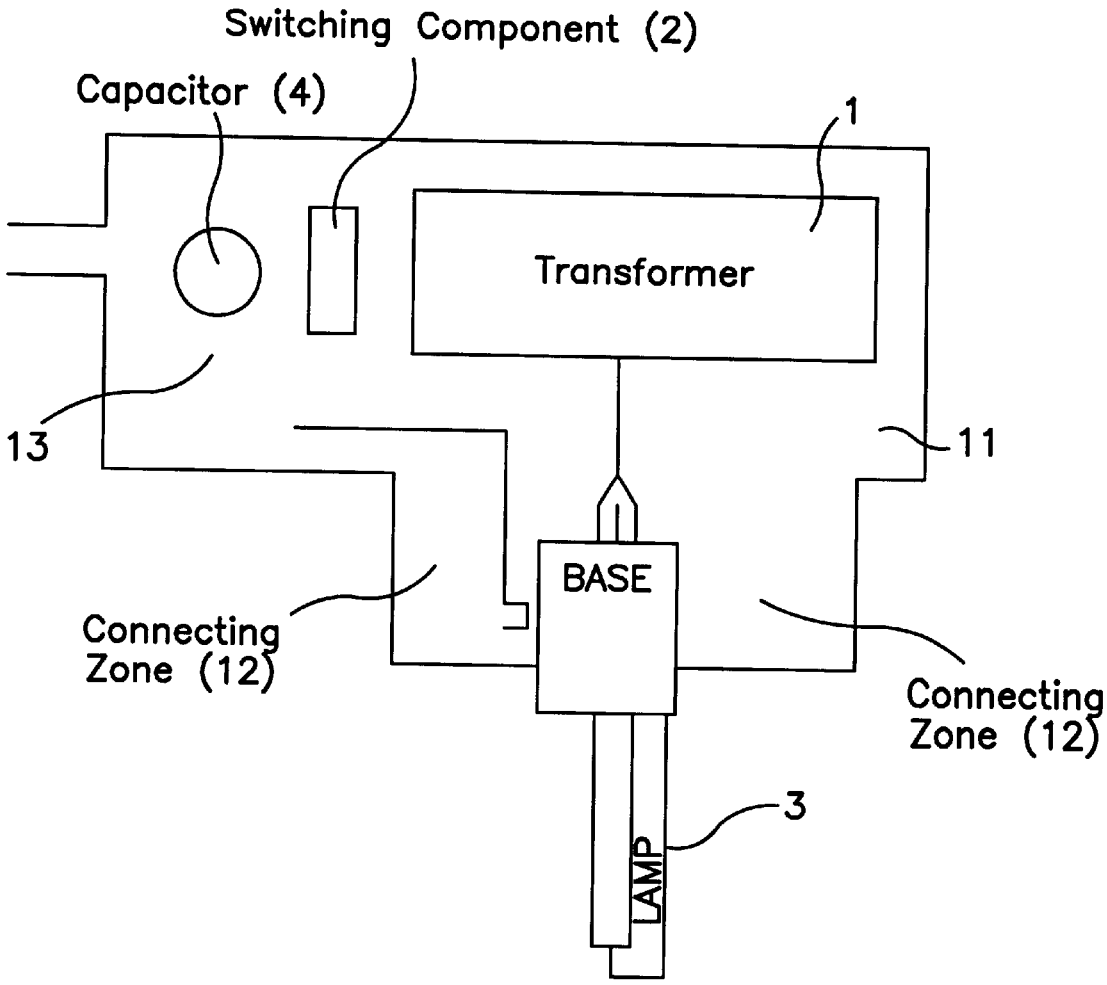
FIG. 6 shows the incorporation of a starter module, in one possible embodiment of the invention, in a discharge lamp connecter.

As will have been understood, the structures of transformers such as have just been described are of particular advantage when it is desired to incorporate the starter module in a lighting unit, for example, and, as is shown in FIGS. 4 and 5, in the base 10 of a discharge lamp; or again, as is shown in FIG. 6, in the housing 11 of a connecter for receiving a discharge lamp.

With reference to FIGS. 4 and 5, the toroidal transformer 1 lies within the base 10, in a plane substantially at right angles to the axis of the discharge lamp 3.

In the embodiment shown in FIG. 6, the transformer 1 is received in a central zone of the housing 11, with its axis being for example coincident with the axis of the connecting zone 12 in which the base of the discharge lamp is received. The housing 11 also has a lateral extension 13 which carries the switching component 2 and capacitor 4 associated with the lamp.

Figure 7A:
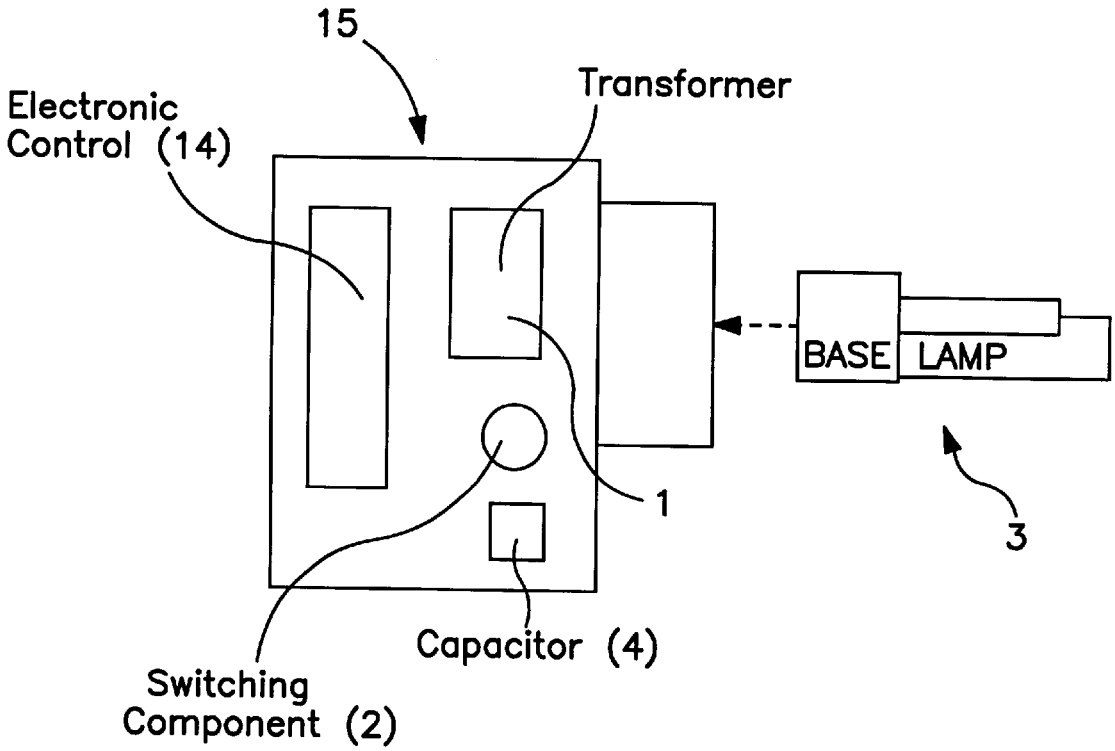
FIGS. 7*a* and 7*b* show the incorporation of a starter module, in one embodiment of the invention, in an electronic module which may or may not be remote from the discharge lamp.

The invention is also applicable, with advantage, in the case where it is required that the starter module be incorporated in an electronic module which provides all or some of the control functions for the operation of a discharge lamp. This is illustrated in FIG. 7*a*, which shows a ballast incorporated in a connecter 15 for receiving a discharge lamp 3. The transformer 1 is also incorporated in this connecter, together with the switching component 2, the capacitor 4 and an electronic control means 14.

Figure 7B:
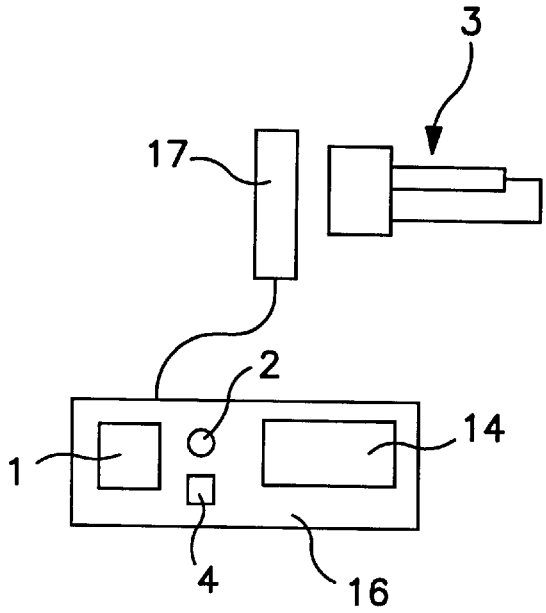

FIG. 7*b* shows the case where the ballast (or part of it) is incorporated in a module 16 which is remote from the connector 17 on which the lamp 3 is fitted, and to which the module 16 is connected.

What is claimed is:

1. A starter module for a motor vehicle discharge lamp, comprising a high tension transformer which includes a magnetic circuit element, a primary winding wound on the magnetic circuit element, a secondary winding wound on the magnetic circuit element, and means associated with the magnetic circuit element for depressing the saturation level of the secondary winding whereby to modify the magnetic characteristics of the transformer.

2. The module according to claim 1, wherein the means for depressing comprise complementary magnetising means.

3. The module according to claim 2, wherein the means for depressing comprise a permanent magnet disposed in the magnetic circuit.

4. The module according to claim 3, wherein the magnetic circuit component defines an air gap, the permanent magnet being disposed in the air gap.

5. The module according to claim 3, wherein the permanent magnet has indexing means to ensure its correct orientation.

6. The module according to claim 2, wherein the complementary magnetising means comprise a third winding wound on the magnetic circuit component.

7. The module according to claim 6, wherein the third winding is continuously energized.

8. The module according to claim 6, wherein the third winding is transiently energized.

9. The module according to claim 1, wherein the magnetic circuit component is an annular core.

10. The module according to claim 1, wherein the means for depressing increase a value of current at which saturation of the magnetic circuit element is reached in a range of about 1.5 to about 4.0 amperes.

11. A motor vehicle discharge lamp comprising:

a base; and a starter module, incorporated in the base, including a magnetic circuit element, a primary winding wound on the magnetic circuit element, a secondary winding wound on the magnetic circuit, and means associated with the magnetic circuit element for depressing the saturation level of the secondary winding whereby to modify the magnetic characteristics of the transformer.

12. A motor vehicle discharge lamp connector including a starter module having a magnetic circuit element, a primary winding wound on the magnetic circuit element, a secondary winding wound on the magnetic circuit, and means associated with the magnetic circuit element for depressing the saturation level of the secondary winding whereby to modify the magnetic characteristics of the transformer.

13. An electronic control module for a discharge lamp incorporating a starter module including a magnetic circuit element, a primary winding wound on the magnetic circuit element, a secondary winding wound on the magnetic circuit, and means associated with the magnetic circuit element for depressing the saturation level of the secondary winding whereby to modify the magnetic characteristics of the transformer.

14. In a starter module for a motor vehicle discharge lamp, a high tension transformer comprising:

an annular magnetic core having an air gap;

a primary winding wound on the core;

a secondary winding wound on the core; and a permanent magnet, disposed in the air gap, for reducing the saturation level of the secondary winding in order to modify the magnetic characteristics of the transformer.

15. The high tension transformer according to claim 14, further comprising a magnet holder, formed of a non-magnetic material, for holding the permanent magnet in the air gap of the core.

* * * * *